US005810565A

United States Patent [19]

Eppli

[11] Patent Number: 5,810,565

[45] Date of Patent: Sep. 22, 1998

[54] REGULATING DEVICE FOR DISPLACEMENT PUMPS

[75] Inventor: Konrad Eppli, Kleindeinbach, Germany

[73] Assignee: ZF Friedrichshafen AG., Friedrichshafen, Germany

[21] Appl. No.: 793,949

[22] PCT Filed: Sep. 15, 1995

[86] PCT No.: PCT/EP95/03629

§ 371 Date: Mar. 12, 1997

§ 102(e) Date: Mar. 12, 1997

[87] PCT Pub. No.: WO96/09475

PCT Pub. Date: Mar. 28, 1996

[30] Foreign Application Priority Data

Sep. 21, 1994 [DE] Germany ..... 44 33 598.9

[51] Int. Cl.[6] ..... F04B 49/00

[52] U.S. Cl. ..... 417/300; 417/308; 417/310

[58] Field of Search ..... 417/300, 308, 417/310

[56] References Cited

U.S. PATENT DOCUMENTS 2,839,003 6/1958 Thrap et al. ..... 417/300

4,473,341 9/1984 Ohe et al. ..... 417/308

*Primary Examiner*—Timothy Thorpe
*Assistant Examiner*—Cheryl J. Tyler
*Attorney, Agent, or Firm*—Larson & Taylor

[57] ABSTRACT

The invention relates to a displacement pump, e.g. a vane cell pump, with a flow control valve (13) on the control piston (22) which acts on the pump pressure on the one hand and the consumer pressure taken via a choke device on the other. The control piston (22) acts as a pressure controller in which the pressure difference as the pump speed rises acts as a measure of the adjusted quantity conveyed. The choke device for setting the pressure difference contains a throttle piston (17) movable against the force of a spring (16) in a piston bore (15), which closes off an aperture (14) on the pressure side in a control plate (7) in the basic position. According to the invention, the piston bore (15) has a by-pass channel (18) which continuously connects the pump with a spring chamber (15A) in the throttle piston (17). In addition, depending on the flow rate, the throttle piston (17) controls the cross-section of a throttle channel (20) providing a connection between the spring chamber (15A) and the outlet channel (21). The arrangement has the advantage that the differential pressure of the control piston (22) cannot affect the throttle piston (17) of the throttle device. As the spring force acting on the throttle piston (17) can be reduced, power is saved.

3 Claims, 2 Drawing Sheets

REGULATING DEVICE FOR DISPLACEMENT PUMPS

BACKGROUND OF THE INVENTION

1. Field of the Invention

The invention relates to a regulating device for displacement pumps, in particular vane cell pumps, which have a pressure chamber which is connected via a bore, in which a throttle piston can be displaced against the force of a spring, with a pressure channel connected to an outlet. The throttle piston controls an outlet cross section as a function of the pump speed (rpm) or of the conveyed flow. In addition, a spring-loaded flow control piston, whose front face is connected with the pressure chamber, is present in a housing bore. A rear face of the feed control piston projects into a chamber which contains the outlet pressure downstream of the throttle device. As a function of the differential pressure acting on the two faces, the flow control piston releases a connection between the pressure chamber and a pump inlet channel.

2. Description of the Prior Art

Such a regulating device is known from DE 41 01 210-A1. During an increase in speed (rpm), the throttle piston in this pump is displaced by means of dynamic pressure acting on a front face. In the process a control edge intersects a piston opening connected to a pressure chamber, so that the reduction in the cross section of the opening allows less and less hydraulic oil to flow to an outlet. This arrangement constitutes the throttle device.

The reduction in the cross section of the opening increases the differential pressure acting on the flow control piston, so that the latter regulates a conveyed flow to the pump inlet side so that it becomes gradually less. Since the controllable opening is in the throttle piston, the differential pressure also acts on the back of the piston of the throttle device.

In its base position the throttle piston blocks an opening connected with the pressure chamber or the interior with its front face, for which a comparatively stiff spring is required. During the start-up of the pump it is necessary to overcome this spring force. To this end it is necessary in connection with a double-flow pump to build up a considerably higher pump pressure in one of the pressure zones, so that the pump runs considerably louder because of the different pressures. The piston is furthermore designed as a step piston with a snug fit, which requires a certain manufacturing outlay.

It is the object of the invention to provide a regulating device for a characteristic descending conveyed flow curve with the smallest possible construction outlay, without considerably increasing the power consumption of the pump. In addition, the characteristic descending line is to be independent from the opening path and the differential pressure of the flow control piston in order to avoid a disturbance variable.

SUMMARY OF THE INVENTION

This object is attained by means of the present invention.

The novel throttle device is designed in such a way that, in the area of the bore containing the throttle piston, the pressure chamber is in constant contact with a spring chamber by means of a bypass channel, and the throttle piston controls the cross section of a throttle channel connecting the spring chamber with the outlet chamber.

In accordance with a preferred embodiment it is practical to cast the bypass channel into a bearing housing in the shape of a letter T, wherein the perpendicularly extending channel section is open in the direction toward the bore.

Because of the bypass channel, the effect of the differential pressure is independent of the throttle piston, i.e the differential pressure at the regulating piston cannot act on the throttle piston. This makes the installation of a weaker spring possible, because of which smaller output losses arise.

Finally, in accordance with a more preferred embodiment it is advantageous to influence the start of the movement of the throttle piston, and thus the characteristic conveyed flow curve, by means of a narrow bore in the control plate. A part of the conveyed amount can be diverted toward the pressure chamber in this way.

An exemplary embodiment of the invention will be explained in detail by means of the drawings.

DETAILED DESCRIPTION OF THE PREFERRED EMBODIMENTS

Figure 1:
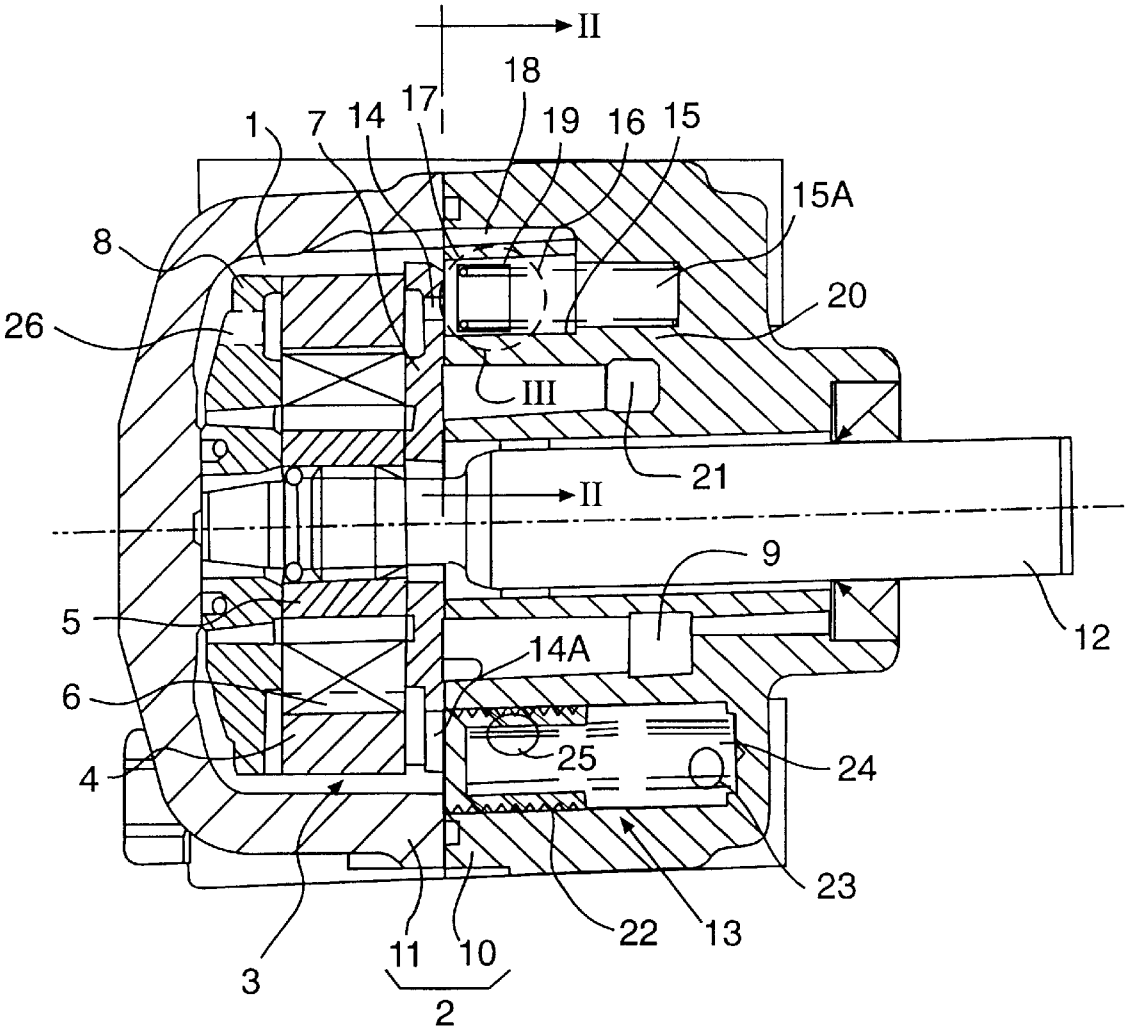
FIG. 1, a longitudinal section through a vane cell pump with the regulating device, wherein the throttle piston and the flow control piston are in their initial position.

The vane cell pump is used for conveying hydraulic oil from a reservoir (not shown) to a consumer (not shown) for example in a power-assisted steering device.

A rotor set 3 has been installed in an oil-filled pressure chamber 1 of a housing 2. The rotor set 3 consists of a curved ring 4 and a rotor 5. The rotor 5 is disposed in the interior of the curved ring 4 and has radially-directed slits, in which vanes 6 can be displaced. Work chambers are formed between the curved ring, the rotor 5 and the vanes 6, which are bordered in the axial direction by control surfaces of neighboring control plates 7 and 8.

The housing 2 has been put together from a bearing housing 10 and a cup-shaped housing cover 11. The rotor 5 is seated in the bearing housing 10 by means of a drive shaft 12. The bearing place in the bearing housing 10 is the only seating of the drive shaft 12. This means that the drive shaft 12 is not seated in the radial direction in the housing cover 11. Instead, the drive shaft is supported in the axial direction on the housing cover 11.

Besides a suction connection, (not shown) for connecting the reservoir, as well as a pressure connection (not shown) for the consumer, a flow control valve 13 for regulating the hydraulic oil conveyed to the pressure connection is provided in the bearing housing 10. The design of the flow control valve 13 and of a further pressure control valve (not shown) is generally known, for example from U.S. Pat. No. 5,098,259, and is therefore not further described. The suction and pressure channels, which connect the work chambers with the suction connection, the flow control valve 13 and the pressure control valve, are also disposed in the bearing housing 10. These channels are also generally known and are therefore not described in more detail.

In a double-flow pump, the control plate 7 has two openings 14 and 14A, which are connected with pressure-conducting work chambers formed between the rotor 5, the curved ring 4 and the vanes 6. In this case the conveying pressure prevails in the pressure chamber 1. A piston bore 15 axially adjoins the upper opening 14. The piston bore 15 contains a throttle piston 17, on which a spring 16 installed in a spring chamber 15A presses. In accordance with the invention, the pressure chamber 1 is continuously connected with an outlet channel 21 leading to the consumer via a bypass channel 18, the spring chamber 15A and a throttle channel 20, which can be controlled by the throttle piston 17. In this case a bevel 19 at the throttle piston 17 controls the throttling process. A suction channel 9 is connected with the oil reservoir.

Figure 2:
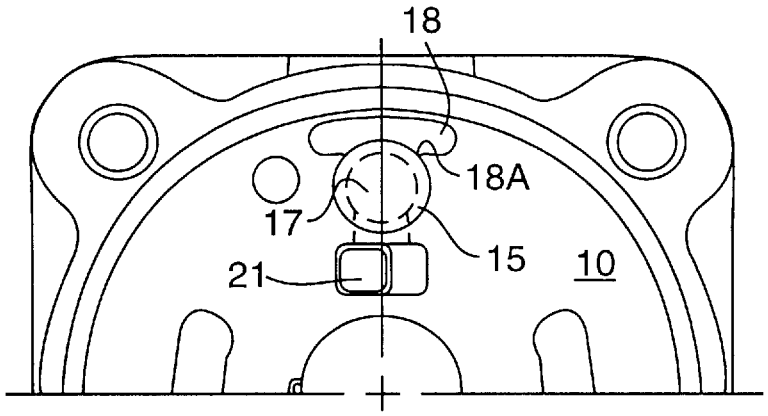
FIG. 2, a partial cross section along the line II—II in FIG. 1.
Figure 3:
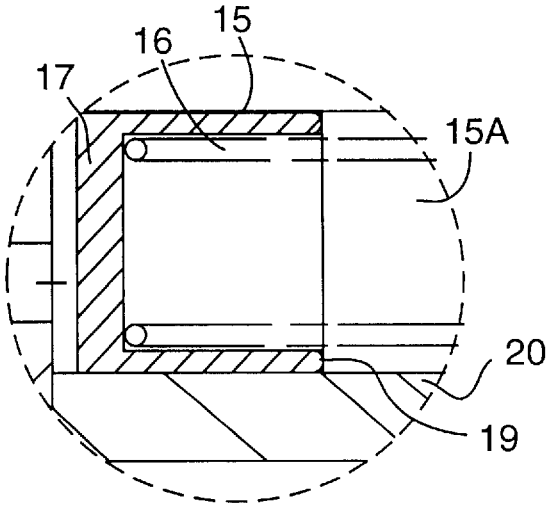
FIG. 3, the detail III in FIG. 1 in an enlarged scale.

As can be seen in the cross section in FIG. 2, the bypass channel 18 has been cast in the shape of a letter T in the bearing housing 10, and a perpendicularly extending channel section 18A of it is open in the direction toward the piston bore 15. Thus, the connection between the pressure chamber 1 and the outlet channel 21 is maintained in every position of the throttle piston 17. The throttle piston 17 therefore does not require a snug fit.

In the initial position, as long as the pump is not operating, the spring 16 pushes the throttle piston 17 against the control plate 7. As soon as the rotor 5 turns, the vanes 6 push the oil enclosed between them through the openings 14 and 14A. In the process the throttle piston 17 is displaced toward the right because of the hydraulic pressure acting on its front face. The greater the increase of the conveyed flow through the opening 14, the further the throttle piston 17 is displaced against the force of the spring 16. In the process the throttle piston 17 more or less reduces the outflow through the throttle channel 20 to the outlet channel 21. It is therefore possible to change the respective flow-through cross section of the throttle channel 20, which determines the amount in the consumer ready to be conveyed by the pump, as a function of the pump speed (rpm). The descending characteristic conveyed flow curve is obtained in this way.

The differential pressure on the front face of the regulating piston 22, which is a part of the flow control valve 13, increases with increasing speed (rpm). The regulating piston 22 acts as a pressure balance and is displaced toward the right against the force of a spring 23 and against the force of an outlet pressure prevailing in a chamber 24. In the process, the front face of the regulating piston 22 opens an inlet channel 25. In this way a partial flow again reaches the feed side of the pump in a known manner.

It is important for the invention that the throttle piston 17 is not affected by the differential pressure of the regulating piston 22 with its spring 23, but is instead displaced by the conveyed flow through the one opening 14 via the bypass channel 18. A continuous displacement path of the throttle piston 17 is obtained with a small spring force by means of this.

The descending characteristic curve can be changed by means of the following criteria:

a) It is possible to affect the start of the movement of the throttle piston 17 by means of a bore 26 in the control plate 8, as indicated by dash-dotted lines;

b) The stiffness of the spring 16;

c) The cross section of the bypass channel 18;

d) The length and shape of the throttle piston 17 and the control bevel 19;

e) The diameter and position of the throttle bore 20.

I claim:

1. A regulating device for displacement pumps having the following features:

a pressure chamber connected with an outlet channel via a bore, in which a throttle piston is displaced against the force of a spring;

the throttle piston controls a throttle channel as a function of a conveyed flow;

a front face of a regulating piston, which is displaceable in a housing bore and is spring-loaded, is connected with a pressure chamber;

a rear face of the regulating piston projects into a chamber subject to an outlet pressure; and the regulating piston releases a connection between the pressure chamber and a pump inlet channel as a function of the differential pressure acting on the front and rear faces, the improvement comprising:

in the area of the bore containing the throttle piston, the pressure chamber is in continuous connection with a spring chamber of the throttle piston via a bypass channel, and the throttle piston (17) controls the cross section of a throttle channel, which connects the spring chamber with the outlet channel.

2. The control device in accordance with claim 1, wherein the bypass channel is cast in a T-shape into a bearing housing to form an extending channel section which is perpendicular to the remainder of the bypass channel and the perpendicularly extending channel section is open toward the bore.

3. The control device in accordance with claim 1, wherein by means of a bore in a control plate it is possible to affect the start of the movement of the throttle piston, and thereby influence the characteristic conveyed flow curve.

* * * * *